US005108684A

United States Patent [19]

Anton et al.

[11] Patent Number: 5,108,684

[45] Date of Patent: Apr. 28, 1992

[54] PROCESS FOR PRODUCING STAIN-RESISTANT, PIGMENTED NYLON FIBERS

[75] Inventors: Anthony Anton, Wilmington, Del.; Peter R. Witt, Lugoff, S.C.; Linda H. Sauerbrunn; Diane M. Scholler, both of Wilmington, Del.; William P. Parmelee; William T. Windley, both of Seaford, Del.; Paul S. Pearlman, Thornton, Pa.

[73] Assignee: E. I. Du Pont de Nemours and Company, Wilmington, Del.

[21] Appl. No.: 284,091

[22] Filed: Dec. 14, 1988

[51] Int. Cl.[5] ..... D01F 1/04

[52] U.S. Cl. ..... 264/176.1; 264/75; 264/211

[58] Field of Search ..... 264/211, 78, 75, 171, 264/176.1

[56] References Cited

U.S. PATENT DOCUMENTS

| | | | |
|---|---|---|---|
| 3,542,743 | 11/1970 | Flamand | 260/78 |
| 3,565,910 | 2/1971 | Elbert et al. | 260/30.8 |
| 3,640,942 | 2/1972 | Crampsey | 260/37 |
| 3,898,200 | 8/1975 | Lofquist | 264/210.8 |
| 4,579,762 | 4/1986 | Ucci | 428/95 |

FOREIGN PATENT DOCUMENTS

| | | | |
|---|---|---|---|
| 2308266 | 9/1973 | Fed. Rep. of Germany | 264/78 |
| 145415 | 6/1988 | Japan . | |

*Primary Examiner*—Hubert C. Lorin

[57] ABSTRACT

Process for producing producer-colored nylon fibers which are stain-resistant to acid dyes are made by adding pigment to nylon copolymers containing 0.25–4.0 percent by weight of an aromatic sulfonate or an alkali metal salt thereof.

10 Claims, 2 Drawing Sheets

PROCESS FOR PRODUCING STAIN-RESISTANT, PIGMENTED NYLON FIBERS

BACKGROUND OF THE INVENTION

Nylon can be dyed with acid dyes and therefore it can also be stained by natural or artificial acid dyes existing in some foods and drinks when they are spilled on nylon fabrics or carpets. The current way of avoiding such staining is to topically apply to the surface of the filaments materials which function as stain-blockers or stain-resist agents, thus preventing acid stains from permanently coloring the yarn. Such treatment, however, can be costly.

Alternatively, it is known from Flamand U.S. Pat. No. 3,542,743, Crampsey U.S. Pat. No. 3,640,942 and Ucci U.S. Pat. No. 4,579,762 that small amounts of certain materials which confer cationic dyeability on nylon, such as aromatic sulfonates and their alkali metal salts, may be copolymerized with the nylon as a means of rendering the nylon resistant to staining by acid dyes.

Recently, yarn producers have begun incorporating colored pigments into nylon yarns to improve their resistance to degrading and fading in ultraviolet light, to give improved resistance to chemicals and noxious fumes and to give permanent coloration which is not removed by washing. However, when light shades of pigment are used, acid dye stains from accidental spills are visible on the surface of the filaments.

While some pigments can be mixed easily into the nylon without adversely affecting the filament spinning operation, most pigments cause some difficulties while being mixed into the nylon or in subsequent spinning and drawing operations. In general, organic pigments cross link nylon, raise its viscosity, form spherulites which weaken the fibers and cause increased draw tension and filament breaks. Many inorganic pigments depolymerize the nylon, raise the number of amine ends (thereby increasing the susceptibility of the nylon to acid dye stains), lower the viscosity and also form spherulites. For example, pigments containing iron oxide or zinc ferrite and particularly a combination of the two give very poor operability. Either type of pigment in large particles weakens the fibers, clogs the spinning pack filters and causes breaks. On the other hand, very finely divided pigment agglomerates to form larger masses of varying size, causing the same problems as large particles, but such masses also color the polymer unevenly and less effectively due to poor dispersion of the pigment in the polymer.

The depolymerization caused by inorganic pigments is usually worse in the processing of nylon 6,6 than in nylon 6 because of the higher melting temperature of nylon 6,6 and the more reactive nature of nylon 6,6.

Ultraviolet light degrades nylon, and the degradation is accelerated by the presence of certain pigments, particularly metal oxides such as titanium dioxide. To avoid this, copper in various forms is often added to the polymer, but a portion of the copper deposits on internal surfaces of equipment which contacts the polymer. Such difficulty is disclosed in Elbert et al. U.S. Pat. No. 3,565,910. In addition, an amount of copper which is effective in preventing degradation of the polymer by ultraviolet light also causes poor spinning performance. The combination of pigment and copper is still worse.

Ways of avoiding the need to topically stain-proof pigmented nylon filaments and overcoming processing problems caused by the pigment and copper would be greatly desired. It would be particularly useful to be able to use a wide selection of colored pigments, both organic and inorganic, in order to make a complete range of styling colors without encountering serious product deficiencies or operating difficulties with any of them.

SUMMARY OF THE INVENTION

It has now been found that by adding to nylon-forming monomer(s) certain materials which confer cationic dyeability on nylon, such as aromatic sulfonates or their alkali metal salts, polymerizing the nylon-forming salt to form a copolymer, mixing pigment into the molten copolymer, and then spinning the pigment/polymer blend into a fiber, pigmented nylon yarns may be made which not only resist staining by acid dyes but also can be made from a wide range of pigments with greatly reduced operability problems. It is particularly beneficial in dispersing finely-divided pigments in the nylon, making the coloration more uniform and using less pigment, encouraging the formation of small particles instead of large.

It has also been found that the presence of such cationic dyeability additives improves the operability of polymer containing both pigment and copper to an acceptable level. Consequently, the presence of the cationic dyeability additives allows for the use of up to 200 parts per million (ppm), preferably 10 to 100 ppm, and most preferably 40–100 ppm of copper in the form of cuprous or cupric ions to be added to the nylon salt prior to polymerization in order to provide, without significant operability problems, stability against ultraviolet light degradation.

BRIEF DESCRIPTION OF THE DRAWINGS

The file of this patent contains at least one drawing executed in color. Copies of this patent with color drawing(s) will be provided by the Patent and Trademark Office upon request and payment of the necessary fee.

Figure 1:
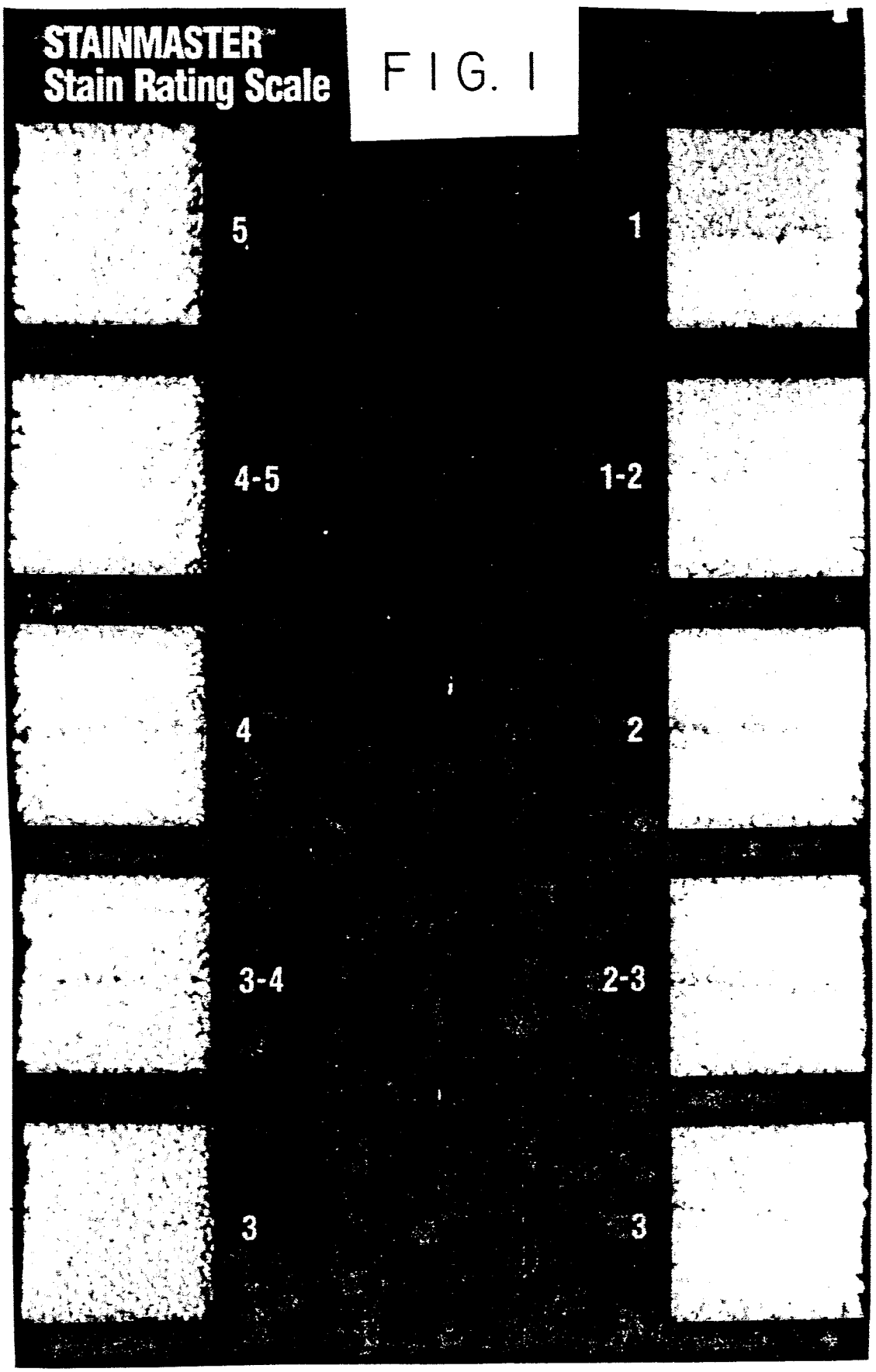
FIG. 1 is a color photograph of the Stain Rating Scale used to characterize the level of staining of carpets described hereinafter.

Suitable cationic dye additives which may be used to produce the stain-resistant yarns of this invention include those aromatic sulfonates and their alkali metal salts which are capable of copolymerizing with polyamide-forming raw materials. Examples of such compounds include sulfonated dicarboxylic acids and the diesters of such diacids, with the most preferred additive being the alkali metal salts of 5-sulfoisophthalic acid, As used in this disclosure the term "stain-resistant" refers to fibers or carpets made therefrom having a stain-rating of 4 or 5 as determined according to any of the Stain Tests described more fully hereinafter.

Although the preferred range of additive to be used is 1–2 weight percent, amounts of cationic dyeability additive between 0.25 and 1 percent are effective in preventing staining or operability problems in many cases, while 1–2 weight percent is satisfactory for most combinations of pigment and copper. Up to 4 percent may be needed for severe problems, but above that level the additive itself begins to lower the relative viscosity of the polymer, give poorer operability, and show staining from disperse dyes.

Since the cationic dyeability additive is incorporated into the polymer chain, the fibers of this invention are uniformly stain-resistant and do not require topical treatment to impart stain-resistance. As such, problems previously encountered in making hollow-filament, stain-resistant fibers may be avoided. Heretofore, topical stain-resist agents when applied to hollow-filament fibers did not adequately penetrate into the interior voids of the filaments. When subsequently exposed to staining agents which seeped into the voids, visible staining could be detected. The fibers of this invention, made stain-resistant based upon modification to the polymer chain, overcome this drawback in topically imparting stain-resistance to hollow filaments.

Along with their value in providing stain-resistance, the present cationic dyeability additives can be said to function as dispersants, facilitating the mixing of pigments uniformly into the polymer. In the prior art, dispersants have usually been incorporated in the pigment concentrate with the pigment. In the process embodiments of the present invention, the cationic dyeability additive is added to the other ingredients at the salt stage, before polymerization and before pigment is added.

A wide range of both organic and inorganic pigments may be added to the modified nylon copolymers of this invention. The pigments are generally introduced in the form of a concentrate formulation containing one or more "pure" pigments, the number, color and proportion of which are based on the final color shade desired, as well as other materials such as lubricants and polymeric additives, including various types of nylon. With respect to those containing nylon polymers, it has now been found that the stain rating after washing of products of this invention is enhanced by using pigment concentrates containing less than about 40% nylon 6.

The products of this invention are generally characterized by having lower lightness values than fibers which are made without the addition of any pigment. As described in this disclosure lightness is measured using the CIE 1976 CIELAB L* metric lightness function as standardized by CIE, the Commission Internacional de L'Eclairage. As can be seen from TABLE A, Controls B and C, the lightness of uncolored nylon fibers copolymerized with the cationic dye additive 5-sulfoisophthalic acid is greater than 88. The inorganic white pigment titanium dioxide which has long been used in small quantities as a delustering agent for nylon, generally being introduced into the manufacturing process as an additive prior to polymerization, serves to maintain or raise the lightness of such fibers even higher. To the extent certain very light colored pigments could be used to make a fiber from a nylon copolymer having a lightness value greater than or equal to 88, such fibers will have a chroma greater than 8 as measured using the CIE 1976 CIELAB C* color scale.

TABLE A

| FIBER DESIGNATION | PIGMENT COLOR | CATIONIC DYE ADDITIVE (%) | $TiO_2$ (%) | COPPER PPM | CIELAB L* | CIELAB C* |
|---|---|---|---|---|---|---|
| CONTROL A | NONE | 2 | 0.3 | 0 | 91.98 | 2.01 |
| CONTROL B | NONE | 2 | 0.0 | 0 | 91.90 | 0.98 |
| CONTROL C | NONE | 2 | 0.0 | 0 | 91.95 | 1.50 |
| CONTROL D | NONE | 2 | 0.0 | 66 | 89.98 | 6.60 |
| FIBER E | LIGHT BEIGE | 2 | 0.0 | 66 | 77.56 | 8.98 |
| FIBER F | LIGHT GRAY | 2 | 0.0 | 66 | 74.66 | 4.77 |
| FIBER G | WINE | 2 | 0.0 | 66 | 36.20 | 24.50 |
| FIBER H | BLUE | 2 | 0.0 | 66 | 34.58 | 7.33 |
| FIBER I | BLACK | 2 | 0.0 | 66 | 21.79 | 0.80 |

(The CIELAB L* and CIELAB C* values shown on TABLE A were measured using the Applied Color Systems 1800 Model 50 Color Control System with specular component included, a 25 mm sample viewing area, standard (D65) illumination and a 10 degree observer. The fiber samples were wound on a 3 inch by 3 inch (7.5 cm by 7.5 cm) gray card a sufficient number of times to generate a thickness such that the card was not visible behind the fiber in the area exposed to the light source of the spectrophotometer of the Color Control System.)

While the operability of most pigments is improved by a cationic dyeability additive, the performance of nylon with some pigments which do not degrade operability appreciably may be made slightly worse by the additive by lowering the relative viscosity of the polymer somewhat. This can usually be tolerated when the product must be made resistant to acid dye staining.

The process embodiments of this invention are useful in coloring and providing stain resistance to all types of nylon, including, without limitation, both nylon 6 and nylon 6,6, as well as nylon copolymers.

In addition to being used to spin stain-resistant, pigmented nylon fibers and fabrics, nylon copolymers made using the cationic dye additives described herein may be compounded with pigments to form stain-resistant, pigmented nylon resins useful in a wide variety of non-fiber applications including, for example, films and blow-molded products.

DESCRIPTION OF TEST METHODS

In the following Description of Test Methods and in the Examples, parts and percentages are by weight unless otherwise indicated.

STAIN TEST #1

To test the resistance of nylon carpet yarn to staining with acid dye, a sample approximately 6"×6" (15 cm×15 cm) is cut from a piece of carpet tufted from the yarn to be tested.

A staining agent, cherry-flavored sugar-sweetened Kool-Aid ® (sold commercially), is prepared by mixing 45 gms. (±1) of Kool-Aid ® in 500 cc of water, and allowed to reach room temperature, i.e., 75° F. (±5° F.) or 24° C. (±3° C.), before using.

The carpet sample is placed on a flat, non-absorbent surface; 20 ml of Kool-Aid ® are poured onto the carpet specimen from a height of 12 inches (30 cm) above the carpet surface, and the specimen is then left undisturbed for a period of 24 hours. To confine the stain, a cylinder approximately two inches (5 cm) in diameter may be placed on the carpet and the stain may be poured through it.

Excess stain is blotted with a clean white cloth or clean white paper towel or scooped up as much as possible, without scrubbing. Blotting is always performed from the outer edge of spill in towards the middle to keep the spill from spreading. Cold water is applied with a clean white cloth or a sponge over the stained area, gently rubbing against the pile from left to right and then reversing the direction from right to left. The excess is blotted.

A detergent cleaning solution (15 gms (±1) of TIDE detergent mixed in 1000 cc of water, and also allowed to reach room temperature before using), is applied with a clean white cloth or a sponge directly to the spot, gently rubbing the pile from left to right and then reversing the direction from right to left. The entire stain is treated, all the way to the bottom of the pile, and then the blotting is repeated.

The cold water treatment is repeated, and the carpet is blotted thoroughly, to remove the stain and also the cleaning solution, so the carpet does not feel sticky or soapy.

The cold water and detergent cleaning steps are repeated until the stain is no longer visible, or no further progress can be achieved. The carpet is blotted completely to absorb all the moisture.

The stain-resistance of the carpet is visually determined by the amount of color left in the stained area of the carpet after this cleaning treatment. This is referred to as the stain-rating, and is herein determined according to the Stain Rating Scale (that is illustrated in FIG. 1, said figure being a photograph of a Stain Rating Scale) that is currently used by and available from the Flooring Systems Division of E. I. du Pont de Nemours and Company, Wilmington, Delaware 19898. These colors can be categorized according to the following standards:

5=no staining
4=slight staining
3=noticeable staining
2=considerable staining
1=heavy staining In other words, a stain-rating of 5 is excellent, showing excellent stain-resistance, where 1 is a poor rating, showing heavy staining. Although a rating of 5 is clearly preferred, a stain-rating of 4 is considered an indication of acceptable stain resistance.

YARN STAIN TEST—STAIN TEST 2

Instead of tufting nylon yarn into carpet, as per Stain Test 1, the yarn is circular knit into tubing and a sample approximately 6 inches by 6 inches (15 cm by 15 cm) is cut from the tubing. It is then immersed completely in the same staining agent as used in Stain Test 1, worked to distribute the stain thoroughly throughout the sample, and then placed on a flat, non-absorbent surface for 24 hours. At that point, it is rinsed and evaluated as in Stain Test 1.

STAXNING AFTER WASHING—STAIN TEST 3

A detergent solution is prepared by adding 2.0 ≅0.2 ounces of Duponol WAQE to one gallon (3.79 l) of water, adjusting the pH to 10±0.2 with a 10% solution of trisodium phosphate and allowing the solution to reach room temperature, 75° F.±5° (24° C.±3°).

A carpet sample is cut as in Test 1 and is immersed completely in the detergent solution for five minutes. Fresh detergent is used for each sample. The sample is then rinsed thoroughly in water, squeeze-dried, and placed in an extractor to remove excess solution.

The sample is then stained and evaluated as in Test 1.

AMINE END ANALYSIS

Amine end levels are determined as described in U.S. Pat. No. 3,730,685.

EXAMPLES 1 AND 2

A copolymer of nylon 6,6 and 4% nylon 6 was formed by salt blending the ingredients and then polymerizing and cutting into flake for Control 1. The copolymer had 66 parts per million of copper, added as cupric acetate.

For Examples 1 and 2, the nylon 6 was omitted and 2% and 4% respectively of the cationic dyeability additive sodium salt of 5-sulfoisophthalic acid was added at the salt stage, i.e. prior to polymerization. The copolymers formed using these amounts of the additive had 46 amine ends whereas the amine end level of Control 1 was 37.5. In the process of spinning the copolymers of Control 1, Example 1 and Example 2 into a hollow-filament yarn of 64 filaments, 19 dpf, medium blue organic pigment was added at the screw melter. The following improvements in process and product were observed:

Spinning Performance: It can be seen from TABLE B that the number of yarn breaks per 8-hour operating shift per spinning position was dramatically lower in Examples 1 and 2 compared to Control 1. Fewer spherulites and more constant, uniform extrusion were also observed.

Yarn Properties: Most surprisingly, the tenacity of the yarns of Examples 1 and 2 were higher than Control 1, even though the relative viscosities were lower. Usually, lower RV is accompanied by lower tenacity.

Yarn Color: Goal color level was achieved in Control 1 using 4.8 parts per hundred of concentrate, while only 4.2 pph and 4.5 pph were required for Examples 1 and 2 respectively. This observation is consistent with the hypothesis that the cationic dye additive promotes better dispersion of the pigment, with a corresponding increase in tint strength.

Stain Resistance: The shade of blue was sufficiently dark that stains were not likely to be visible, so the samples were not tested for stain resistance.

EXAMPLES 3 AND 4

Nylon 6,6 polymer was prepared with 66 ppm copper added prior to polymerization in the form of cupric acetate. The polymers of Examples 3 and 4 were copolymers made by adding 2% and 3% respectively of the sodium salt of 5-sulfoisophthalic acid to the 6,6 monomers prior to polymerization. Control 2 was prepared without the cationic dyeability additive. Each of these three polymers was then spun into fiber with 4.2% of a brown inorganic pigment concentrate added at the screw melter.

The polymer of Control 2 and the copolymers of Examples 3 and 4 all had between 32 and 46 amine ends. Each was spun and drawn to make 3 denier per filament staple yarns. Again, the presence of the cationic dyeability additive reduced the yarn breaks dramatically as can be seen in Table B. The samples when subjected to Stain Test 2 are rated 5.

Each of these results is quite surprising in that all three yarns had amine end levels between 65 and 70. The increase in amine ends indicates that depolymerization occurred during the spinning/drawing process, and such conditions generally cause a decline in processability, yet in neither Example 3 nor Example 4 was such a decline observed. Similarly, an excess of amine ends correlates with higher acid dyeability, yet the stain-rating of both Example 3 and Example 4 was 5.

EXAMPLES 5 AND 6

As for Control 1, a copolymer of nylon 6,6 and 4% nylon 6 was formed by salt blending the ingredients and then polymerizing and cutting into flake. For purposes of these examples this copolymer is referred to as Control 3. The copolymer had 66 parts per million of copper, added as cupric acetate.

For Examples 5 and 6, the nylon 6 was omitted and 1% and 2% respectively of the cationic dyeability additive sodium salt of 5-sulfoisophthalic acid was added at the salt stage, i.e. prior to polymerization. In the process of spinning the copolymers of Control 3, Example 5 and Example 6 into 1225 denier, 64 filament bulked continuous yarn, medium blue organic pigment was added at the screw melter.

After samples of the yarns were tufted into carpets and subjected to Stain Test 1 above, the yarn of Control 3 were rated an unacceptable 2-3, while the yarns of both Examples 5 and 6 were determined to be a very acceptable 5.

Examples 7-15

Nylon 6,6 was prepared with no copper, 0.3% $TiO_2$ and 2.15% of the cationic dye additive sodium salt of 5-sulfoisophthalic acid added at the salt stage for all items except controls 5 and 6 which had no cationic dye additive. Amine ends of the polymer flake were 40. Pigment concentrates as described in TABLE C were added at the screw melter and 1225 denier 64 filament yarn was spun and bulked in a manner well known to the art. The yarns were tufted into 1/10 inch (2.54 mm) gauge 3/16 inch (4.76 mm) pile height level loop carpets having 24 ounces (0.68 kg) of pile yarn per square yard (0.84 $m^2$). All items were subjected to Stain Test 1, and all items having cationic dye additives achieved a rating of 4 or 5 while those without cationic dye additive, Controls 5 and 6, had ratings of 0 and 1 respectively. A second sample of each of these carpets was then subjected to Stain Test 2 described above. Examples 12, 13, 14, and 15 had a stain rating of 4, the minimum acceptable.

staining (a rating of 4) once the carpet was pre-washed (Stain Test 2). Those having less than 40% 6 nylon and more than 25% multipolymer have fully acceptable stain ratings of 5 before and after washing. The "multipolymer" is Du Pont Elvamide 8063, a terpolymer of nylon 6/6,6/6,10 (46/34/20%).

Control 6 having no cationic dye modifier but containing a color concentrate had a very poor stain rating of 1 under both Stain Test 1 and Stain Test 2 and was very difficult to spin. The spinning pack pressure rose rapidly and the test had to be discontinued within a short time.

EXAMPLE 16

Figure 2:
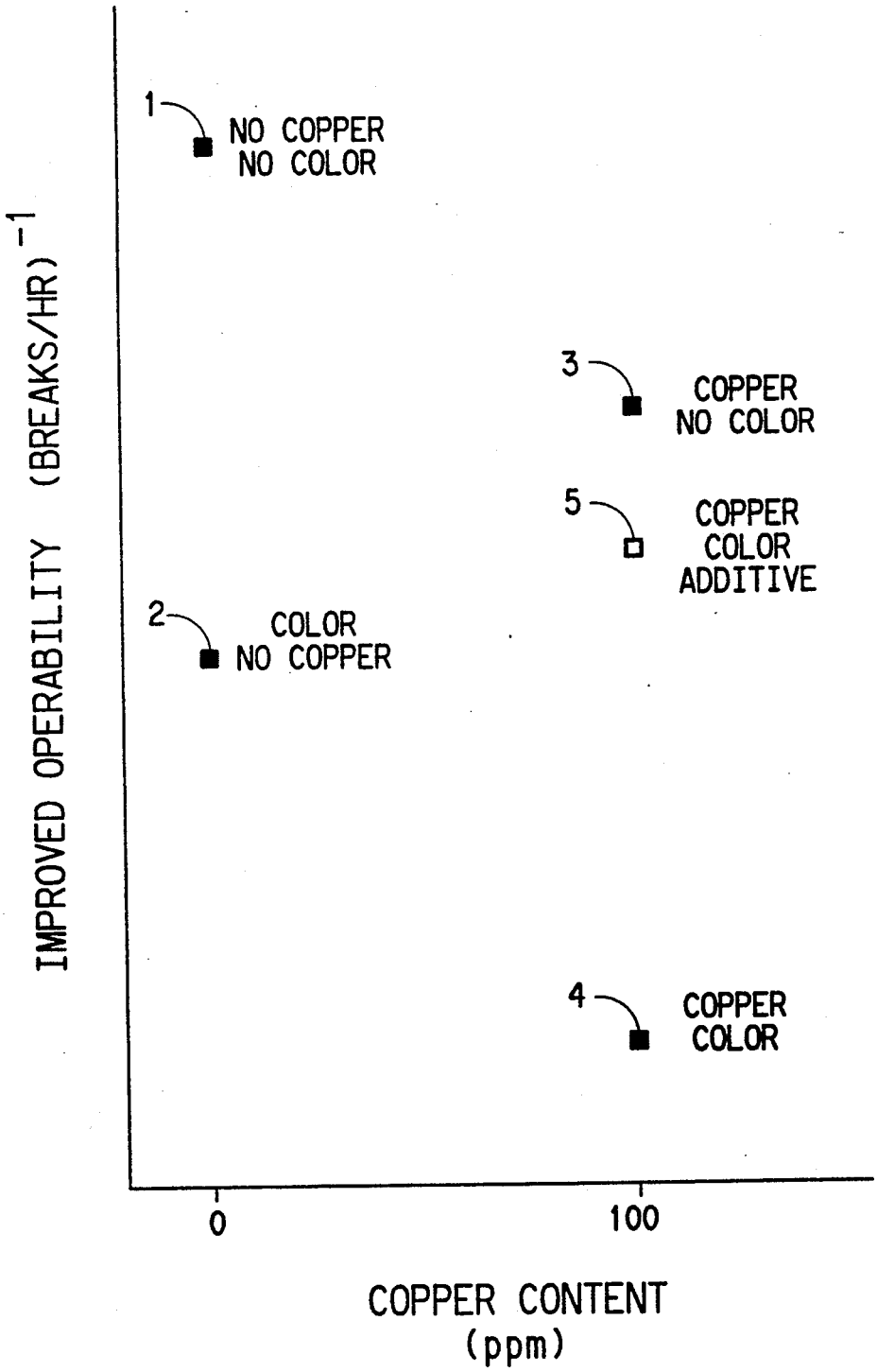
FIG. 2 is a plot showing the effect of copper content, pigment, and cationic dyeability additive on spinning operability.

A series of experiments were conducted to show the effects of pigment, copper and cationic dyeability additive on spinning operability. The same polymer as Control 2 but without copper was prepared and spun, and its performance in terms of the inverse of breaks per hour (i.e. increasing operability along the y-axis) was plotted as point 1 on FIG. 2. The same pigment concentrate as used in Examples 3 and 4 was then added, and its performance was plotted as Point 2. One hundred parts per million copper in the form of cupric acetate was then added to the polymer of Point 1, and its performance was found to be represented by Point 3, about midway between Points 1 and 2. When both copper and pigment were added to the polymer, its operability declined to Point 4. This was barely operable on an experimental basis and too poor to be acceptable as a commercial process. However, the addition of 2% sodium salt of 5-sulfoisophthalic acid raised the operability to Point 5, better than that of pigment alone (Point 2) and commercially acceptable.

TABLE B

| | % Cat. Dye Additive | Breaks/ 8-hr. Shift | Yarn Bulk | Yarn R.V. | Tenacity (gpd) | Elongation % |
|---|---|---|---|---|---|---|
| Control 1 | 0 | 8.8 | 38.8 | 66 | 2.5 | 67 |
| Example 1 | 2 | 2.8 | 39.7 | 57 | 2.7 | 59 |
| Example 2 | 4 | 3.2 | 36.5 | 45 | 2.9 | 62 |
| Control 2 | 0 | 8.0 | | 45 | 4.6 | 68 |
| Example 3 | 2 | 0.8 | | 50 | 5.2 | 62 |
| Example 4 | 3 | 0.8 | | 40 | 4.0 | 71 |
| Control 3 | 0 | | | 64 | 2.8 | 54 |
| Example 5 | 1 | | | 54 | 2.8 | 57 |
| Example 6 | 2 | | | 53 | 2.9 | 52 |

TABLE C

| EXAMPLE NUMBER | % CAT. DYE ADDITIVE | RATING STAIN TEST 1 | RATING STAIN TEST 2 | PIGMENT CONCENTRATE WEIGHT % | PIGMENT CONCENTRATE COLOR | NYLON 6 | MULTI POLYMER | TOTAL NYLON CONC. | OTHER COMPONENTS |
|---|---|---|---|---|---|---|---|---|---|
| EXAMPLE 7 | 2.0 | 5 | 5 | 0.62 | M WINE | 20.00 | 42.00 | 62.00 | 38.00 |
| EXAMPLE 8 | 2.0 | 5 | 5 | 0.59 | M BLUE | 28.57 | 38.72 | 67.29 | 32.71 |
| EXAMPLE 9 | 2.0 | 5 | 5 | 0.81 | M BLUE | 28.57 | 38.72 | 67.29 | 32.71 |
| EXAMPLE 10 | 2.0 | 5 | 5 | 0.81 | YELLOW | 25.00 | 36.75 | 61.75 | 38.25 |
| EXAMPLE 11 | 2.0 | 5 | 5 | 0.81 | PLUM | 34.50 | 48.72 | 83.22 | 16.78 |
| CONTROL 4 | 2.0 | 5 | 4 | 0.00 | | | NOT APPLICABLE | | |
| CONTROL 5 | 0 | 0 | 0 | 0.00 | | | NOT APPLICABLE | | |
| CONTROL 6 | 0 | 1 | 1 | 0.81 | M BLUE | 28.57 | 38.72 | 67.29 | 32.71 |
| EXAMPLE 12 | 2.0 | 5 | 4 | 0.62 | M BROWN | 44.00 | 21.81 | 65.81 | 34.19 |
| EXAMPLE 13 | 2.0 | 4 | 4 | 0.81 | L GRAY | 63.77 | 14.17 | 77.94 | 22.06 |
| EXAMPLE 14 | 2.0 | 5 | 4 | 0.81 | M BROWN | 44.00 | 21.81 | 65.81 | 34.19 |
| EXAMPLE 15 | 2.0 | 5 | 4 | 0.81 | M GRAY | 59.72 | 19.74 | 79.46 | 20.54 |

It was found that carpets made from yarns containing color concentrates with 44.0-59.7% 6 nylon, Examples 12-15, had no staining, i e. a rating of 5, when the carpet was not washed before staining (Stain Test 1), but slight

We claim:

1. A process for producing stain-resistant, pigmented nylon fiber comprising the steps of:

a) forming a sulfonated nylon copolymer containing 0.25–4.0 weight percent of an aromatic sulfonate or an alkali metal salt thereof;

b) adding pigment to the copolymer to form a pigment/polymer blend; and c) spinning the pigment/polymer blend into a fiber, where the fiber so produced has a CIELAB L* value less than 88 or, if the CIELAB L* value is 88 or greater has a CIELAB C* value greater than 8.

2. The process of claim 1 where the aromatic sulfonate is a sulfonated dicarboxylic acid or a sulfonated diester.

3. The process of claim 2 where the sulfonated dicarboxylic acid is 5-sulfoisophthalic acid.

4. The process of claim 3 where the nylon copolymer contains 1.0–2.0 percent by weight of the sodium salt of 5-sulfoisophthalic acid.

5. The process of claim 1, 2, 3, or 4 where the nylon copolymer is a nylon 6,6 copolymer.

6. The process of claim 1, 2, 3, or 4 where the copolymer also contains less than 200 parts per million of copper in the form of cuprous or cupric ions.

7. The process of claim 1, 2, 3, or 4 where the copolymer also contains less than 100 parts per million of copper in the form of cuprous or cupric ions.

8. The process of claim 7 where the pigment is organic.

9. The process of claim 7 where the pigment is inorganic.

10. The process of claim 1, 2, 3, or 4 where the pigment is added in the form of a concentrate containing no more than 40 per cent nylon 6.

* * * * *

US005108684A

REEXAMINATION CERTIFICATE (2051st)

United States Patent [19]

[11] B1 5,108,684

Anton et al.

[45] Certificate Issued Jun. 29, 1993

[54] PROCESS FOR PRODUCING STAIN-RESISTANT, PIGMENTED NYLON FIBERS

[75] Inventors: Anthony Anton, Wilmington, Del.; Peter R. Witt, Lugoff, S.C.; Linda H. Sauerbrunn; Diane M. Scholler, both of Wilmington, Del.; William P. Parmelee; William T. Windley, both of Seaford, Del.; Paul S. Pearlman, Thornton, Pa.

[73] Assignee: E. I. Du Pont de Nemours and Company, Wilmington, Del.

Reexamination Request:
No. 90/002,850, Oct. 7, 1992

Reexamination Certificate for:

| | |
|---|---|
| Patent No.: | **5,108,684** |
| Issued: | **Apr. 28, 1992** |
| Appl. No.: | **284,091** |
| Filed: | **Dec. 14, 1988** |

[51] Int. Cl.[5] ..... D01F 1/04

[52] U.S. Cl. ..... 264/176.1; 264/75; 264/211

[58] Field of Search ..... 264/75, 78, 171, 176.1, 264/211; 8/497, 557; 524/601, 602, 606, 612; 528/336, 337

[56] References Cited

U.S. PATENT DOCUMENTS

| | | | |
|---|---|---|---|
| 3,846,507 | 11/1974 | Thomm et al. | 525/432 |
| 4,030,880 | 6/1977 | Holfeld et al. | 8/489 |
| 4,374,641 | 2/1983 | Burlone | 8/557 |
| 4,592,940 | 6/1986 | Blyth et al. | 428/96 |
| 4,780,099 | 10/1988 | Greschler et al. | 8/115.6 |
| 4,839,212 | 6/1989 | Blyth et al. | 428/96 |
| 4,879,180 | 11/1989 | Blyth et al. | 428/395 |

FOREIGN PATENT DOCUMENTS 1169301 11/1969 United Kingdom .

*Primary Examiner*—Leo B. Tentoni

[57] ABSTRACT

Process for producing producer-colored nylon fibers which are stain-resistant to acid dyes are made by adding pigment to nylon copolymers containing 0.25–4.0 percent by weight of an aromatic sulfonate or an alkali metal salt thereof.

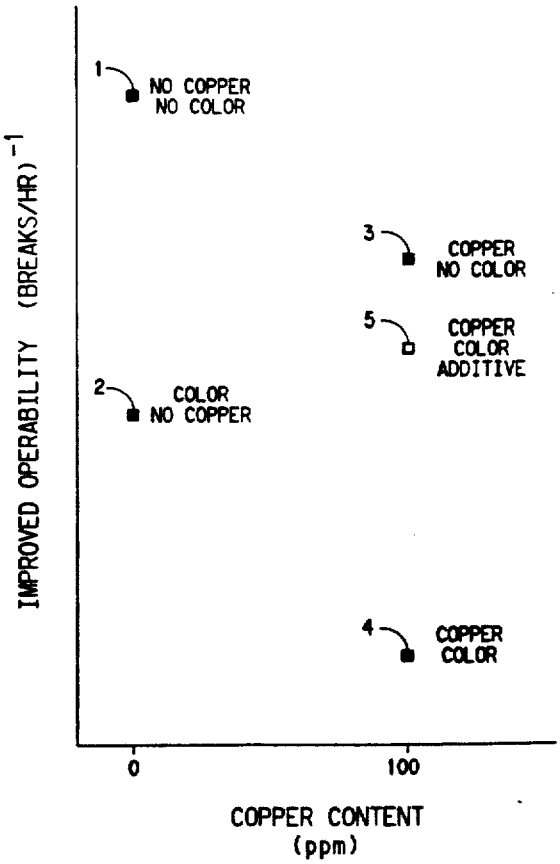

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claim 1 is determined to be patentable as amended.

Claims 2–10, dependent on an amended claim, are determined to be patentable.

1. A process for producing stain-resistant, pigmented nylon fiber comprising the steps of:

a) forming a sulfonated nylon copolymer containing 0.25–4.0 weight percent of an aromatic sulfonate or an alkali metal salt thereof;

b) adding pigment to the copolymer to form a [pigment/polymer] *pigment/copolymer* blend; and c) spinning the [pigment/polymer] *pigment-/copolymer* blend into a fiber, where the fiber so produced has a CIELAB L* value less than 88 or, if the CIELAB L* value is 88 or greater has a CIELAB C* value greater than 8.

* * * * *

US005108684A

REEXAMINATION CERTIFICATE (2298th)

United States Patent [19]

[11] B2 5,108,684

Anton et al.

[45] Certificate Issued May 10, 1994

[54] PROCESS FOR PRODUCING STAIN-RESISTANT, PIGMENTED NYLON FIBERS

[75] Inventors: Anthony Anton, Wilmington, Del.; Peter R. Witt, Lugoff, S.C.; Linda H. Sauerbrunn; Diane M. Scholler, both of Wilmington, Del.; William P. Parmelee; William T. Windley, both of Seaford, Del.; Paul S. Pearlman, Thornton, Pa.

[73] Assignee: E. I. Du Pont de Nemours and Company, Wilmington, Del.

Reexamination Request:
No. 90/003,043, Apr. 29, 1993

Reexamination Certificate for:

| | |
|---|---|
| Patent No.: | **5,108,684** |
| Issued: | **Apr. 28, 1992** |
| Appl. No.: | **284,091** |
| Filed: | **Dec. 14, 1988** |

Reexamination Certificate B0 5,108,684 issued Jun. 29, 1993.

[51] Int. Cl.[5] ..... D01F 1/04

[52] U.S. Cl. ..... 264/176.1; 264/75; 264/211

[58] Field of Search ..... 264/75, 78, 171, 176.1, 264/211; 8/497, 557, 924, 925; 524/601, 602, 606, 612; 528/336, 337

[56] References Cited

U.S. PATENT DOCUMENTS

| | | | |
|---|---|---|---|
| 3,184,436 | 5/1965 | Magat | 528/321 |
| 3,389,549 | 6/1968 | David | 428/202 |
| 3,553,286 | 1/1971 | Murata et al. | 525/375 |
| 3,846,507 | 11/1974 | Thomm et al. | 525/432 |
| 4,303,577 | 12/1981 | Ridgway et al. | 524/158 |
| 4,374,641 | 2/1983 | Burlone | 8/557 |

*Primary Examiner*—Leo B. Tentoni

[57] ABSTRACT

Process for producing producer-colored nylon fibers which are stain-resistant to acid dyes are made by adding pigment to nylon copolymers containing 0.25–4.0 percent by weight of an aromatic sulfonate or an alkali metal salt thereof.

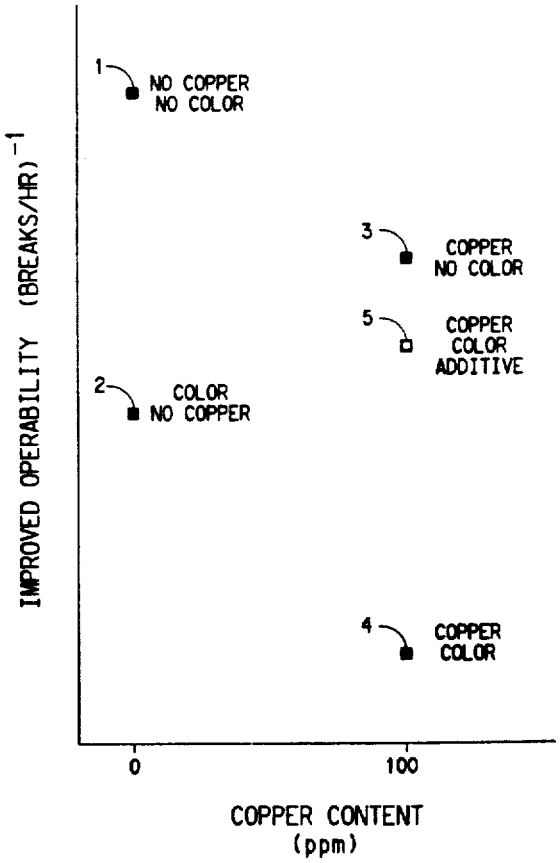

REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1-10 is confirmed.

* * * * *